US006973367B2

(12) United States Patent
Klink et al.

(10) Patent No.: US 6,973,367 B2
(45) Date of Patent: Dec. 6, 2005

(54) METHOD FOR PRODUCING A BORE

(75) Inventors: Ulrich Klink, Neuffen (DE); Gerhard Flores, Ostfildern (DE)

(73) Assignee: Maschinenfabrik Gehring GmbH & Co. KG, Ostfildern (DE)

( * ) Notice: Subject to any disclaimer, the term of this patent is extended or adjusted under 35 U.S.C. 154(b) by 0 days.

(21) Appl. No.: 10/711,138

(22) Filed: Aug. 27, 2004

(65) Prior Publication Data

US 2005/0054270 A1 Mar. 10, 2005

Related U.S. Application Data

(63) Continuation-in-part of application No. 10/248,087, filed on Dec. 17, 2002, now abandoned.

(30) Foreign Application Priority Data

Dec. 20, 2001 (EP) ..... 01130399

(51) Int. Cl.[7] ..... B24B 33/00; G06F 19/00

(52) U.S. Cl. ..... 700/159; 700/90; 29/888.06; 123/193.1

(58) Field of Search ..... 700/90, 159; 123/193.1; 29/888.01, 888.06; 82/1.2, 1.3

(56) References Cited

U.S. PATENT DOCUMENTS 4,765,096 A * 8/1988 Lang ..... 451/124
4,884,210 A * 11/1989 Blaimschein ..... 700/159
5,095,662 A * 3/1992 Grimm et al. ..... 451/5
5,419,037 A * 5/1995 Bailey ..... 29/888.061
5,497,693 A * 3/1996 Ward ..... 92/169.1
5,655,854 A * 8/1997 Foulk ..... 408/1 R
5,681,210 A 10/1997 Lin et al. ..... 451/157
6,394,710 B1 * 5/2002 Kurz ..... 408/1 R
6,901,797 B2 * 6/2005 Hyatt et al. ..... 33/543

FOREIGN PATENT DOCUMENTS

DE 40 07 121 * 9/1990

OTHER PUBLICATIONS

Patent Abstracts of Japan, No. 11267960 A, JPO Oct. 5, 1999.*

* cited by examiner

*Primary Examiner*—Jayprakash N. Gandhi
(74) *Attorney, Agent, or Firm*—Gudrun E. Huckett

(57) ABSTRACT

In a method for machining bores of workpieces with a desired nominal shape of the bores in operative condition, a bore with a desired nominal shape in inoperative condition is produced in a workpiece and the workpiece is then put in operative condition. A deviation of the desired nominal shape of the bore resulting from the operative conditions is determined. Based on the deviation, an initial shape which shape the bore must have in inoperative condition in order for the bore to assume the desired nominal shape in operative condition is the determined. Bores are then produced by employing the determined initial shape as a template.

17 Claims, 3 Drawing Sheets

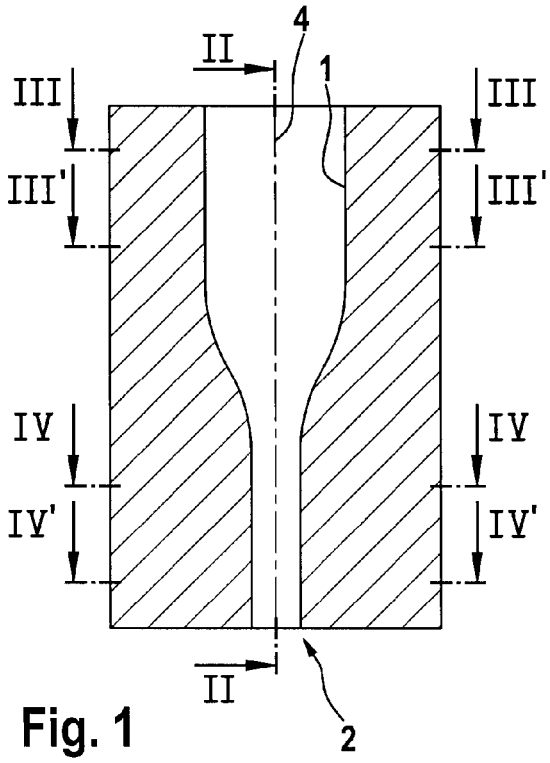
Fig. 1
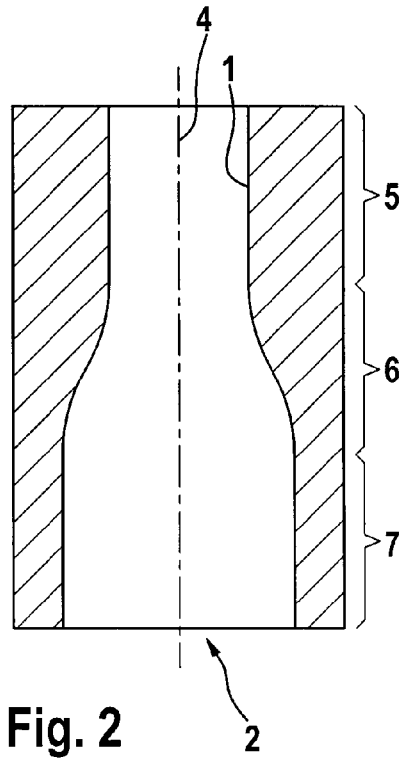
Fig. 2
Fig. 3
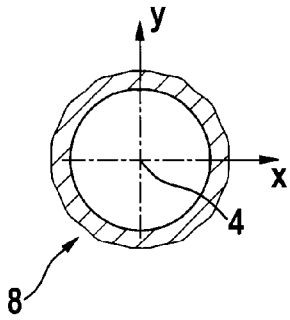
Fig. 4
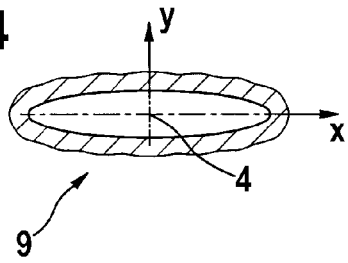
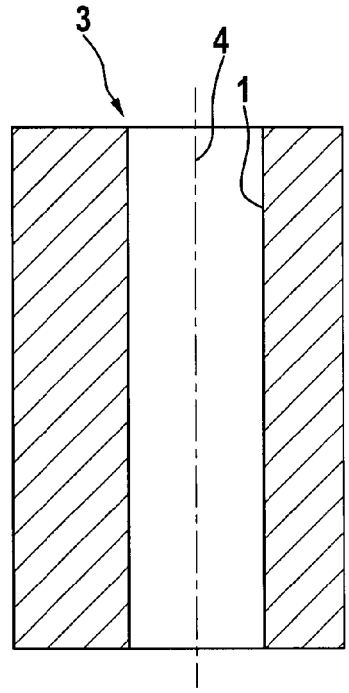
Fig. 5

METHOD FOR PRODUCING A BORE

This application is a continuation-in-part of application Ser. No. 10/248,087 having a filing date of Dec. 17, 2002 now abandoned.

BACKGROUND OF THE INVENTION

The invention relates to a method for machining bores of workpieces, e.g. the cylinder bores of a motor block for combustion engines, with a desired nominal cylindrical shape in operative condition.

When pistons move up and down in a bore of a motor block of an internal combustion engine, a certain optimum shape, e.g. a cylindrical shape, is desired. This is the "nominal shape". This shape is usually produced.

After manufacture and after having been put into operation, i.e., after the engine has been started and has reached its operating conditions, e.g. temperature and load, the original nominal cylindrical shape will change. This deviation from the nominal state, which the bore had in its inoperative initial condition, will result in a shape in operative condition that is not the desired nominal one. For example, if the nominal shape in inoperative condition is cylindrical, the deviation caused by temperature and load may result in a slightly elliptical shape in operative condition, which is no longer optimal. It is desired that especially in operative conditions the shape should be the nominal shape that is originally designed in order to have a minimal gap between the cylinder wall and the piston so that optimum use is made of the burned fuel while minimal pressure loss and leakage of exhaust gas are incurred.

The machining operations considered in this connection may be grinding, finishing or honing of the bore. The operative condition or state refers to a situation where the combustion engine is in operation, whether in idling condition or under full load.

In order to provide a cylindrical bore during operation, it is proposed in Japanese patent document 11267960 to clamp the bore during machining with original tension screws and the original torque as employed in the operational state. In order to additionally simulate deformation caused by temperature effects, it is known to heat the workpiece by means of hot honing oil. However, this method for manufacturing the bore causes a great expenditure as a result of the required devices. This machining process results in high costs. Because of the relatively long heating period to temperatures of 80° C. to 140° C., the required safety devices, the seal wear, and the required temperature conditioning, this method is used only for custom machining of high-quality engines. The actual deformation state in operation is moreover simulated only insufficiently by the aforementioned devices.

It has already been suggested to produce bores with an elliptical cross section (U.S. Pat. No. 5,681,210, see col. 4, lines 60–56). The elliptical cross section was considered to be the desired final shape in order to make as much use as possible of the space available in a motor block of given dimensions (see U.S. Pat. No. 5,681,210, col. 1, line 23). The deformations resulting from the temperature rise when such an engine is put into operation are much less than the deformations thought to result from the method disclosed in said patent. Changes resulting from operating conditions are neither considered nor compensated.

The same applies to the disclosure of German patent application 40 07 121 showing a device for honing oval bores.

SUMMARY OF THE INVENTION

It is an object of the present invention to provide a method for producing, especially honing, bores in cylindrical workpieces such that the bores will have their desired, i.e., nominal, shape when in operative condition.

It is a further object of the invention to provide such method requiring only minimal expenditure.

In accordance with the present invention, this is achieved in that the method for producing bores in workpiece comprises the steps of:

a) producing in a workpiece a bore with the desired nominal shape in inoperative condition;

b) putting the workpiece in operative condition;

c) determining the deviation (deformation) of the initial shape of the bore resulting from step b) in comparison to the shape resulting from step a);

d) determining from the results of step c) the shape that the bore must have in inoperative condition in order for the bore to assume the nominal shape in operative condition;

(e) producing the bore having the initial shape determined in step d), wherein several bores can be produced by employing the initial shape of step d) as a template.

The method according to the present invention proposes that the deformation or deviation that results from putting such a workpiece in operative conditions is determined. Based on this deformation, it can be determined which initial configuration is required to provide the nominal shape when the workpiece is put into operation. As a first approximation, the change of the initial shape with respect to the desired nominal shape would be the same as the one resulting from putting the workpiece having a bore of the desired nominal shape in operation. If, for example, the original cylindrical bore in operation undergoes a change in which a certain diameter is 10 $\mu$m larger than in the inoperative condition, the original cylindrical shape of the bore should be corrected in this direction to be correspondingly smaller in regard to its initial shape.

Ultimately, for each geometry and operative condition (temperature, load) easy measurements will show whether this approximation will be sufficient or must be slightly modified. The determination in accordance with step d) above must be made for each particular bore geometry and each operation state. However, the determination has to be done only once and the determined shape (initial shape) which the bores must have in the inoperative state in order to assume the desired nominal shape in operation can be used as a template. This makes the method according to the present invention particularly well suited for mass production. Moreover, the method according to the present invention is significantly cheaper than the methods disclosed in the state of the art, e.g. the method of deforming the workpiece by clamping or by heating the workpiece during machining. Also, the method according to the present invention is much more precise than the methods of the prior art.

According to one embodiment of the invention, it is provided that the nominal shape, i.e., the shape under operating conditions, is cylindrical. A different configuration variant provides that the initial shape is cylindrical. In particular in the case of a cylindrical nominal shape, it is proposed to determine the initial shape theoretically.

Expediently, the deformation is determined experimentally. In particular, the deformation is determined by static pressing and measuring of the obtained geometry. In order to obtain especially precise deformation data, it can be advantageous to determine the deformation by dynamic measurement in operation. The deformation can also be determined theoretically, in particular, by computer simulation.

It is provided that the initial shape is produced by temporally and locally varying processing parameters. In principle, the initial shape can be manufactured by methods such as defined cutting, grinding, spark erosion, or honing. The processing method is however particularly a honing method, wherein the tool is a honing tool that is arranged on a spindle and comprises at least one honing stone which is pressed at an advancing pressure against the wall of the bore. It is provided that the advancing pressure of at least one honing stone can be varied during the course of honing. The advancing pressure is varied, in particular, as a function of the rotational position of the spindle. In this way, different inner bore radii can be obtained in the circumferential direction of the bore. Expediently, the advancing pressure is varied as a function of the lifting position of the spindle so that different inner bore radii are produced in the axial direction of the bore.

A honing machine for performing the method comprises one to four honing stones wherein the advancing pressure for each honing stone is separately controlled. The separate control of the advancing pressure for each honing stone enables different inner bore radii for small areas of the bore periphery. The length of the honing stone in the direction of the bore is particularly smaller or identical to the length of individual bore sections with approximately identical geometry. As a result of the minimal length of the honing stones in the axial direction of the bore different inner bore diameters can be realized.

BRIEF DESCRIPTION OF THE DRAWING

FIG. 1 is a section of a bore having initial shape.

FIG. 2 is a section along the line II—II of FIG. 1.

FIG. 3 is a schematic illustration of a section along the line III—III or III'—III' of FIG. 1.

FIG. 4 shows a schematic illustration of a section along the line IV—IV or IV'—IV' of FIG. 1.

FIG. 5 is a section of a bore having nominal shape (operational shape).

DESCRIPTION OF THE PREFERRED EMBODIMENTS

Figure 6:
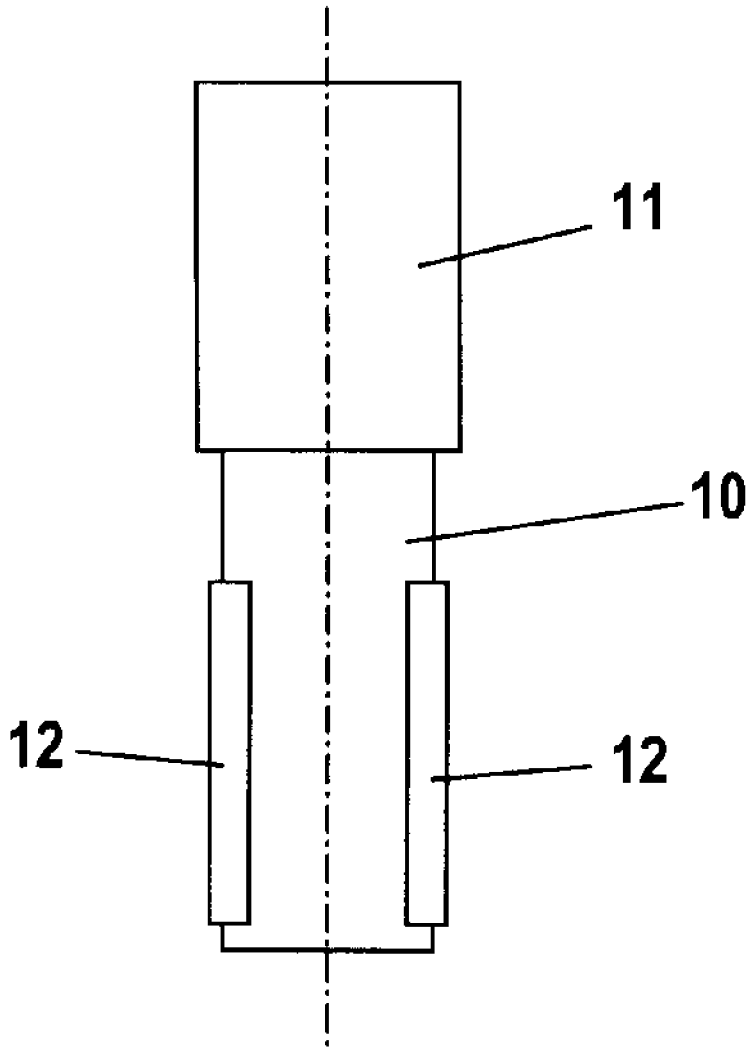
FIG. 6 shows schematically a honing tool.

For the manufacture of a bore 1 with the cylindrical nominal shape 3 illustrated in FIG. 5, which nominal shape results by deformation in the operational state, first the initial shape 2 of the bore 1 illustrated in FIGS. 1 and 2 is to be determined. The initial shape 2 is the shape of the bore 1 before being mounted. The initial shape 2 is substantially cylindrical in its upper area 5 and elliptical in its lower area 7. The illustration of the deviation of the elliptical shape from the cylindrical shape is not true to scale in FIGS. 1 and 2 but is shown greatly enlarged. In fact, the deviation is in the range of approximately 8 to 60 $\mu$m. The central area 6 is a transition area from the cylindrical cross-sectional shape 8 to the elliptical cross-sectional shape 9. The cylindrical cross-sectional shape 8 is illustrated in FIG. 3 and the elliptical cross-sectional shape 9 in FIG. 4.

Figure 7:
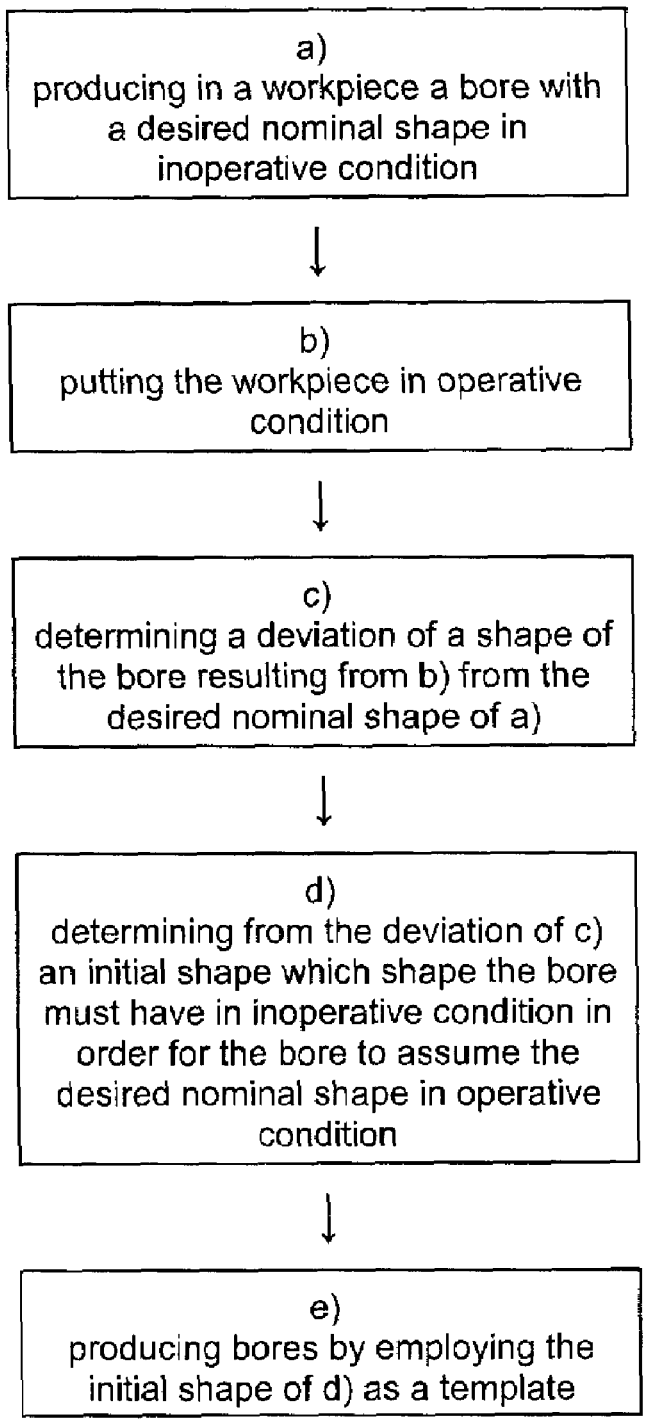
FIG. 7 is a flow chart illustrating the inventive method steps for producing a bore.

For determining the initial shape 2 (i.e., the shape that the bore must have in inoperative condition in order for the bore to assume the nominal shape in operative condition), the deformation (deviation) of the bore from nominal shape 3 is determined in the operational state (step c) of FIG. 7). The deformation can be determined experimentally by static clamping. For this purpose, a bore, in particular, a cylinder bore of a motor block, in the nominal shape 3, in particular, in cylindrical shape, is produced. Expediently, the bore is machined by honing. The bore having the nominal shape 3 is then exposed to loads which occur during operation (operative conditions). For this purpose, the cylindrical bore can be clamped, for example, by means of the cylinder head, wherein the tension screws used for fixation are tightened with the torque predetermined for operation with use of the original seals. Depending on the operational state and the required precision, additionally or alternatively, the component can be heated to operating temperature and/or a pressure loading can be carried out with the pressures that predominantly occur in the operational state. The thus caused shape softening or shape deviation is determined by shape testing measurements.

However, the deformation can also be determined by dynamic measuring of the shape change in the operational state. The dynamic measurement is carried out particularly during firing in the case of cylinder bores. The deformation can also be determined theoretically, in particular, by computer simulation. The computer simulation simulates the deformation during the firing operation with all detectable parameters. Expediently, the method with which the deformation is determined is selected as a function of the required precision and of the expenditure required for the determination.

Based on the determined deformation relative to the nominal shape 3, the initial shape 2 is theoretically determined (step d) in FIG. 7). A bore having the initial shape 2 is then produced (step e) in FIG. 7) by means of a processing method, in particular, by means of a honing method, wherein the determined initial shape 2 can be used as a template especially for mass-producing bores.

The honing machine for processing the bore comprises one to four honing stones (FIG. 6). The advancing pressure with which each honing stone 12 is pressed against the wall of the bore 1 can be controlled for each honing stone 12 separately. The honing tool 10 carries out an oscillating movement in the direction of the axis 4 of the bore 1 and a rotary movement about the axis 4. For machining the upper area 5 of the bore 1, all honing stones 12 are pressed with the same advancing pressure against the wall of the bore 1. The advancing pressure is not varied for the duration of machining. In this way, the cylindrical cross-sectional shape 8 illustrated in FIG. 3 results. For producing the elliptical cross-sectional shape 9 which is illustrated in FIG. 4, the advancing pressure on the honing stones 12 is increased in the direction of the axis X and is decreased in the direction of the axis Y. In the central area 6 the advancing pressure is controlled additionally as a function of the travel position of the spindle 11 on which the honing tool 10 is fixed. Since the bore geometry in the central area 6 changes continuously, the honing stones 12 with their minimal axial expansion are used. For obtaining a higher precision, the tool has a lower and/or an upper guide.

When bores are required which have an inner contour which deviates from that of a cylindrical shape, the contour illustrated in FIG. 5 can represent the initial shape and the bore shape resulting under load can be the contour illustrated in FIGS. 1 and 2 which then represents the nominal shape.

Basically, other machining processes which enable the manufacture of an inner contour deviating from the cylinder shape can be used also for manufacturing the bore by means of the inventive method.

While specific embodiments of the invention have been shown and described in detail to illustrate the inventive principles, it will be understood that the invention may be embodied otherwise without departing from such principles.

What is claimed is:

1. A method for machining bores of workpieces with a desired nominal shape of the bores in operative condition, the method comprising the steps of:

a) producing in a workpiece a bore with a desired nominal shape in inoperative condition;

b) putting the workpiece in operative condition;

c) determining a deviation of a shape of the bore resulting from step b) from the desired nominal shape of step a);

d) determining from the deviation of step c) an initial shape which shape the bore must have in inoperative condition in order for the bore to assume the desired nominal shape in operative condition;

e) producing bores by employing the initial shape of step d) as a template.

2. The method according to claim 1, wherein the desired nominal shape or the initial shape is cylindrical.

3. The method according to claim 1, wherein in the step d) the initial shape is determined theoretically.

4. The method according to claim 1, wherein the deviation is determined experimentally.

5. The method according to clean 4, wherein in the step b) static pressing is employed and the obtained geometry is measured to determine the deviation.

6. The method according to claim 1, wherein in the step b) the workpiece is heated to operational temperature.

7. The method according to claim 1, wherein the deviation is determined by dynamic measuring during operation.

8. The method according to claim 1, wherein the deviation is determined theoretically.

9. The method according to claim 8, wherein computer simulation is used for determining the deviation.

10. The method according to claim 1, wherein in the step e) the initial shape is produced by employing temporally and locally varied processing parameters.

11. The method according to claim 1, wherein in the step e) honing is used, wherein the tool is a honing tool, arranged on a spindle and comprising at least one honing stone pressed with an advancing pressure against a wall of the bore.

12. The method according to claim 11, wherein in the step e) the advancing pressure of at least one honing stone is varied during honing.

13. The method according to claim 12, wherein the advancing pressure is varied as a function of a rotational position of the spindle.

14. The method according to claim 13, wherein the advancing pressure is varied as a function of a lifting position of the spindle.

15. The method according to claim 12, wherein the advancing pressure is varied as a function of a lifting position of the spindle.

16. The method according to claim 1, wherein the bore is a cylinder bore of a reciprocating piston machine.

17. A method for machining bores of workpieces with a desired nominal shape of the bores in operative condition, the method comprising the steps of:

a) producing in a workpiece a bore with a desired nominal shape in inoperative condition;

b) putting the workpiece in operative condition;

c) determining a deviation of a shape of the bore resulting from step b) from the desired nominal shape of step a);

d) determining from the deviation of step c) an initial shape which shape the bore must have in inoperative condition in order for the bore to assume the desired nominal shape in operative condition;

e) producing a bore having the initial shape determined in step d).

* * * * *